United States Patent [19]

Kielman et al.

[11] Patent Number: 4,568,476

[45] Date of Patent: Feb. 4, 1986

[54] ENZYMATIC MACHINE-DISHWASHING COMPOSITIONS

[75] Inventors: Hendrik S. Kielman, Maassluis; Jan S. Bongers, Vlaardingen, both of Netherlands

[73] Assignee: Lever Brothers Company, New York, N.Y.

[21] Appl. No.: 638,006

[22] Filed: Aug. 6, 1984

[30] Foreign Application Priority Data

Aug. 15, 1983 [GB] United Kingdom ..... 8321924

[51] Int. Cl.[4] ..... C11D 3/395; C11D 7/54

[52] U.S. Cl. ..... 252/95; 252/99; 252/102; 252/174.12; 252/186.31; 252/186.38; 252/523; 252/527; 252/546; 252/DIG. 12

[58] Field of Search ..... 252/95, 99, 102, 523, 252/527, 546, 186.31, 186.38, DIG. 12, 174.12

[56] References Cited

U.S. PATENT DOCUMENTS

| | | | |
|---|---|---|---|
| 3,637,339 | 1/1972 | Gray | 252/95 |
| 3,676,352 | 7/1972 | Grimm et al. | 252/174.12 |
| 3,784,476 | 1/1974 | Kampen et al. | 252/174.12 |
| 3,799,879 | 3/1974 | Francke et al. | 252/89 |
| 3,960,665 | 6/1976 | Villadsen et al. | 252/99 |
| 4,003,700 | 1/1977 | Gray et al. | 252/95 |
| 4,021,360 | 5/1977 | McLaughlin et al. | 252/99 |
| 4,162,987 | 7/1979 | Maguire, Jr. et al. | 252/135 |
| 4,338,210 | 6/1982 | Clements et al. | 252/174.12 |
| 4,404,115 | 9/1983 | Tai | 252/174.12 |
| 4,421,664 | 12/1983 | Anderson et al. | 252/174.12 |
| 4,448,705 | 5/1984 | Gray | 252/95 |

FOREIGN PATENT DOCUMENTS 2116198 9/1983 United Kingdom .

*Primary Examiner*—Paul Lieberman
*Assistant Examiner*—Hoa Van Le
*Attorney, Agent, or Firm*—Milton L. Honig; James J. Farrell

[57] ABSTRACT

Mildly alkaline enzymatic machine dishwashing composition comprising a detergency builder, an amylolytic enzyme, a peroxy compound bleach and optionally a proteolytic enzyme, having a pH of from 9.3 to 10.8 determined from a solution of 3 g/l of the composition in distilled water, and containing not more than 0.2% by weight, preferably not more than 0.1% by weight of chloride. The composition is non-corrosive to silverware.

9 Claims, No Drawings

ENZYMATIC MACHINE-DISHWASHING COMPOSITIONS

This invention relates to enzymatic cleaning compositions which are particularly suitable for use in automatic dishwashing machines.

Conventional automatic dishwashing compositions are highly alkaline products comprising a chlorine-containing bleach having a solution pH generally above 11.5. Though performance-wise these conventional detergent compositions are quite satisfactory, they have some serious drawbacks in other respects. Highly alkaline compositions have the disadvantage of being hazardous and the incorporation of chlorine bleaches, though effective for stain removal, requires special processing and storage precautions to protect the composition components which are subject to deterioration upon direct contact with the active chlorine. The stability of the chlorine bleach is also critical and raises additional processing and storage difficulties. A further disadvantage is the difficulty of dyeing and perfuming of such compositions due to the instability of dyes and perfumes towards chlorine.

A mildly alkaline enzymatic machine dishwashing composition comprising a peroxy compound bleach would not have the above disadvantages.

The invention therefore relates to mildly alkaline enzymatic machine dishwashing compositions comprising a peroxy compound bleach.

Mildly alkaline compositions will have a solution-pH of not more than 11.0, as determined from a solution of 3 g/l of the composition in distilled water.

Enzyme-containing machine-dishwashing compositions are known in the art.

Thus, French Pat. No. 1 544 393 teaches detergent compositions for cleaning dishes, containing sodium perborate, an amylolytic enzyme and in addition optionally a proteolytic enzyme, the detergent composition having a solution pH of from 7 to 9.

U.S. Pat. No. 4,162,987 teaches a bleach-free enzymatic automatic dishwashing composition having a pH in use of from about 8.5–11.5, preferably from 9.5–10.5.

However, low to mildly alkaline enzyme and bleach containing machine dishwashing compositions suffer from one serious drawback in that they tend to cause rather severe tarnishing of silverware, which generally cannot be removed satisfactorily by using conventional antioxidants, such as benztriazole. The lower the pH, the more serious is this defect.

Besides, although these organic tarnish inhibitors, especially benzotriazole, may retard the tarnishing of silver, they are not only expensive materials, but in some countries the use of such complex organic compounds in dishwashing compositions is even prohibited by law owing to the risk of being left on the surface of washed articles for use in contact with food for human consumption.

It has been discovered that this tendency to cause silver tarnishing is connected with the presence of chlorides, especially from alkalimetal chlorides, in the formulation.

Alkalimetal chlorides, particularly sodium chloride, may be introduced in the formulation of mildly alkaline enzymatic machine dishwashing compositions through various sources, but the main portion will get into the formulation through the use of commercial enzyme granules of which the majority contains substantial proportions of sodium chloride as diluent. Furthermore, soil on dishes may frequently contain sodium chloride, which may aid in increasing the chloride content in the wash liquor. Also tap water may contain chloride ions in amounts which vary from place to place.

It is therefore an object of the present invention to avoid or at least mitigate the problem of silver tarnishing to a substantial degree in mildly alkaline enzymatic machine dishwashing compositions comprising a peroxy compound bleach.

This and other objects which may be apparent from the further description of the invention can be achieved by keeping the chloride content in the formulation as low as possible.

The tendency to and rate of silver tarnishing increase with the level of chloride in the wash liquor. Since the amount of chloride that is brought into the wash liquor by soil and water is beyond control, the risk of passing the maximum allowable chloride level in the wash liquor can be diminished by controlling the chloride content in the formulation.

Accordingly, in its broadest aspect the enzymatic cleaning composition of the invention is a mildly alkaline composition having a solution pH of from about 9.3 to 10.8, which comprises an amylolytic enzyme, a peroxy compound bleach and a very low to substantially nil level of chloride.

According to the invention the chloride content [$Cl^-$] of the composition should not exceed 0.2% by weight, preferably not more than 0.1% by weight and more particularly should be substantially nil, to avoid or at least mitigate the risk of silver tarnishing to a substantial degree.

By solution pH is meant here the pH as determined from a solution of 3 g/l of the composition in distilled water.

More specifically, the invention provides an effective and safe mildly alkaline enzymatic detergent cleaning composisition adapted for use in automatic dishwashing machines, having a solution pH of from 9.3 to 10.8, preferably from 9.5 to 10.5, and comprising a detergency builder and an amylolytic enzyme, characterized in that it comprises:

(i) from 0.2 to 5% by weight of an amylolytic enzyme such that the final composition has amylolytic enzyme activity of from $10^3$ to $10^6$ Maltose Units/kg;

(ii) from 5 to 25% by weight of a peroxy compound bleach selected from the group of solid peroxy acids and their salts; and mixtures of a solid hydrogen peroxide adduct with an activator wherein the ratio by weight of said hydrogen peroxide adduct to activator is within the range of from 10:1 to 1:1, preferably from 5:1 to 1.5:1; and (iii) not more than 0.2%, preferably not more than 0.1% by weight of chloride, [$Cl^-$].

The amylolytic enzymes for use in the present invention can be those derived from bacteria or fungi. Preferred amylolytic enzymes are those prepared and described in British patent specification No. 1 296 839, cultivated from the strains of *Bacillus licheniformis* NCIB 8061, NCIB 8059, ATCC 6334, ATCC 6598, ATCC 11 945, ATCC 8480 and ATCC 9945 A. Examples of such amylolytic enzymes are amylolytic enzymes produced and distributed under the trade-name of SP-95® or Termamyl® by Novo Industri A/S, Copenhagen, Denmark. These amylolytic enzymes are generally presented as granules and may have have enzyme activities of from about 2 to 10 Maltose units/- milligram. Enzyme granules containing only minor proportions e.g. less than 30%, particularly not more than 10% by weight of chloride or without chlorides are preferably used in the compositions of the invention.

The amylolytic activity can be determined by the method as described by P. Bernfeld in "Method of Enzymology", Volume I (1955), page 149.

As the solid peroxyacid any organic peracid as described in European patent applications Nos. 0 027 146 and 0 027 693 can be used. A preferred solid organic peracid is monoperoxyphthalic acid, which can be used in the form of its magnesium salt having the formula:

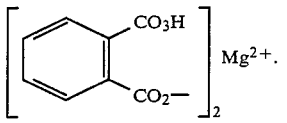

Another type of solid peroxyacid is the class of inorganic persulphates of which potassium monopersulphate is the most common representative.

Examples of solid hydrogen peroxide adducts (percompounds) which can be used together with an activator in the present invention are the alkali metal perborates (mono- or tetrahydrate), percarbonates and persilicates. Preferred hydrogen peroxide adducts are sodium perborate and sodium percarbonate.

The activators for percompounds which are used in the present invention are organic compounds which react with the hydrogen peroxide adduct in solution to form an organic peracid, as the effective bleaching species. Numerous examples of activators of this type, often referred to as bleach or peracid precursors, are known in the art. Preferred activators for use in the present invention are tetraacetylethylene diamine (TAED), tetraacetylglycoluril (TAGU), glucose pentaacetate (GPA), xylose tetraacetate (XTA), and sodium acyloxy benzene sulphonate (SABS).

Other suitable activators or peracid precursors are described for example in British Pat. Nos. 836 988; 855 735; and 907 356; U.S. Pat. Nos. 246,339; 3,332,882 and 4,128,494; Canadian Pat. No. 844 481 and in a series of Articles by Allan H. Gilbert in "Detergent Age", June 1967, pages 18–20, July 1967, pages 30–33, and August 1967, pages 26, 27 and 67.

The composition of the invention may further and preferably contain the following components:

Stabilizing agents for the bleaching agent:

Stabilizing agents which can be used herein are ethylene diamine tetraacetate (EDTA) or the compounds as disclosed in EP No. 0 037 146.

Preferred stabilizing agents are ethylene diamine tetra-(methylene phosphonic acid) and diethylene triamine penta-(methylene phosphonic acid) or their water-soluble salts. They may be added as such or preferably in the form of their Calcium, Magnesium, Aluminium or Zinc Complexes as described in U.S. Pat. No. 4,259,200; especially their Calcium Complexes are particularly preferred.

Proteolytic enzymes:

Examples of suitable proteolytic enzymes are the subtilisins which are obtained from particular strains of *B. subtilis* and *B. licheniformis*, such as the commercially available subtilisins Maxatase®, supplied by Gist-Brocades N.V., Delft, Holland, and Alcalase®, supplied by Novo Industri A/S, Copenhagen Denmark.

Particularly suitable is a protease obtained from a strain of Bacillus having maximum activity throughout the pH range of 8–12, being commercially available from Novo Industri A/S under the registered trade names of Esperase® and Savinase®. The preparation of these and analogous enzymes is described in British Pat. No. 1 243 784.

These enzymes are generally presented as granules, e.g. marumes, prills, T-granulates etc, and may have enzyme activities of from about 500 to 1700 glycine units/milligram. The proteolytic activity can be determined by the method as described by M. L. Anson in "Journal of General Physiology", Vol. 22 (1938), page 79 (one Anson Unit/g=733 Glycine Units/milligram.)

Enzyme granules containing only minor proportions, e.g. less than 30%, particularly not more than 10% by weight of chloride or without chlorides are preferably used in the composition of the invention.

A small amount of low to non-foaming nonionic surfactant, which includes any alkoxylated nonionic surface-active agent wherein the alkoxy moiety is selected from the group consisting of ethylene oxide, propylene oxide and mixtures thereof, is preferably used to improve the detergency and to suppress excessive foaming due to some protein soil. However, an excessive proportion of non-ionic surfactant should be avoided.

Examples of suitable nonionic surfactants for use in the invention are the low- to non-foaming ethoxylated straight chain alcohols of the Plurafac® RA series, supplied by the Eurane Company; of the Lutensol® LF series, supplied by the BASF Company and of the Triton® DF series, supplied by the Rohm & Haas Company.

"Plurafac", "Lutensol" and "Triton" are Registered Trade-Marks.

Organic and inorganic builder materials can be used in the present invention. Suitable inorganic builders include polyphosphates, for example triphosphates, pyrophosphates or metaphosphates, carbonates, bicarbonates, borates and alkalimetal silicates; some of these may act as buffering agents as well. Particularly preferred are the sodium and potassium salts of the above-mentioned inorganic builders. Examples of water-soluble organic builders include the alkalimetal salts of polyacetates, carboxylates, polycarboxylates and polyhydroxysulphonates. Additional examples include sodium citrate, sodium nitrilotriacetate, sodium oxydisuccinate and sodium mellitate. Normally these builder and/or buffering ingredients are used in an amount of up to about 90% by weight of the composition.

Preferred compositions of the invention will comprise:

(a) from 0.2 to 5% by weight of an amylolytic enzyme such that the final composition has amylolytic activity of from $10^3$ to $10^6$ Maltose Units/kilogram (MU/kg);

(b) from 25 to 60% by weight of sodium triphosphate;

(c) from 0 to 40%, preferably from 7.5 to 40% and particularly from 10 to 35% by weight of a buffering agent, selected from borax, metaborate and sodium carbonate;

(d) from 2 to 15% by weight of sodium silicate, having $SiO_2$:$Na_2O$ ratio of from 1:1 to 4:1, preferably from 1.5:1 to 3:1;

(e) from 5 to 25% by weight of a peroxy compound bleach selected from the group of solid peroxy acids and their salts; and mixtures of a solid hydrogen peroxide adduct with an activator wherein the ratio by weight of said hydrogen peroxide adduct to activator is within the range of from 10:1 to 1:1, preferably 5:1 to 1.5:1;

(f) from 0.05 to 1% by weight of a stabilizing agent for the bleaching agent;

(g) from 0.2 to 5% by weight of a proteolytic enzyme such that the final composition has proteolytic enzyme activity of from $10^6$ to $10^8$ Glycine Units/kilogram (GU/kg);

(h) from 0.1 to 5% by weight of a low- to non-foaming nonionic surfactant; and (i) from 0 to not more than 0.2% by weight of chloride, the amounts of components (b), (c) and (d) being so adjusted that the composition will have sufficient builder and buffering capacity to maintain a solution pH of from 9.3–10.8, preferably from 9.5–10.5.

A preferred builder/buffer mixture (b/c/d) is sodium triphosphate, sodium carbonate and sodium disilicate ($SiO_2$:$Na_2O$ ratio from 2:1 to 2.5:1).

A further improvement in reducing the tendency of silver-tarnishing can be achieved by adding a small amount of a fatty acid having a chain length of from about $C_{12}$ to $C_{18}$. Amounts of from about 0.5% to about 5% by weight in the composition have been found effective. This is particularly important when formulations are prepared having a pH in the lower range of e.g. between 9.3 and 10.

The enzymatic detergent cleaning composition of the invention will generally be presented in the form of a dry particulate product which may be prepared by the conventional route of dry mixing the particulate or granular components and followed by spraying the liquid components, if any, e.g. nonionic surfactant, on to said mixture.

The following illustrating examples show compositions of the invention withoutlimiting thereto:

EXAMPLES I–VI

| Composition (% by weight) | I | II | III | IV | V | VI |
|---|---|---|---|---|---|---|
| Sodium carbonate | 35.0 | 10.0 | — | 15.0 | — | 15.0 |
| Borax | — | — | 15.0 | — | 15.0 | — |
| Sodium triphosphate | 28.2 | 40.0 | 35.0 | 45.0 | 35.0 | 45.0 |
| Amylase granules (3.8 MU/mg) | 0.3 | 1.0 | 1.0 | 3.0 | 1.0 | 3.0 |
| Proteolytic enzyme granules (1100 GU/mg) | — | 1.0 | 1.0 | 2.0* | 1.0 | 2.0* |
| TAED | 2.0 | 2.0 | 2.0 | 4.0 | 2.0 | 4.0 |
| Sodium perborate tetrahydrate | 5.0 | 15.0 | 6.0 | 10.0 | 6.0 | 10.0 |
| EDTMP (stabilizer) | 0.2 | 0.4 | 0.2 | 0.7 | 0.2 | 0.7 |
| Sodium disilicate ($SiO_2/Na_2O$ = 2.4) | 12.0 | 12.0 | 10.0 | 5.0 | 10.0 | 5.0 |
| Alkaline silicate | 0.5 | — | — | — | — | — |
| Sodium sulphate | 15.2 | 10.0 | 27.0 | 10.0 | 28.0 | 10.5 |
| Nonionic surfactant (Plurafac ® RA 40) | 1.5 | 1.5 | — | 1.5 | — | 1.5 |
| $C_{14}$-fatty acid | — | — | 1.0 | 0.5 | — | — |
| Salt (sodium chloride content) | 0.1 | 0.1 | 0.1 | 0.1 | 0.0 | 0.0 |
| Water | | | up to 100 | | | |
| pH | 10.8 | 10.6 | 9.7 | 10.5 | 9.8 | 10.6 |

*Proteolytic enzyme granules (657 GU/mg)

EXAMPLE VII

To show the need for a low chloride level in the formulation, machine dishwashing experiments were carried out using products of Compositions V and VI which do not contain any corrosion inhibitor.

Because under practical conditions a varying level of chloride is present, depending on the supplier of the tap water and the composition of soil residues, the sensitivity towards tarnishing in these experiments was determined as a function of chloride ion concentration in the main wash liquor at two pH values, i.e. pH 9.5 with composition V and pH 10.2 with composition VI.

The experiments were carried out in an Indesit ® dishwashing machine using the normal 65° C. programme (water intake main wash 10 liter demineralized water) and a product dosage of 30 g/machine.

The results on silver plated spoons are given as a score between 1 (=completely untarnished spoon) and 8 (=completely black tarnished spoon) whereby score 2 indicates a tarnished spoon (whole surface slightly tarnished) which is already unacceptable.

The results of the Composition V experiments (pH 9.5) are shown in Table A.

TABLE A

| Chloride level in main wash (mg/l) | % $Cl^-$ in product added to wash liquor of 30 mg/$Cl^-$ | Score |
|---|---|---|
| 0 | — | 1.2 |
| 12 | — | 1.2 |
| 24 | — | 1.2 |
| 30 | — | 1.4 |
| 33 | 0.1 | 1.7 |
| 34.5 | 0.15 | 1.7 |
| 36.5 | 0.20 | 2.0 |
| 37.5 | 0.23 | 2.0 |
| 48.5 | 0.60 | 4.0 |
| 100.0 | 2.33 | 5.7 |

It can be seen from these results that up to a level of 25 mg/l of $Cl^-$ in the wash liquor silver tarnishing does not occur at pH 9.5. Above this level the degree of tarnishing becomes increasingly severe with increasing chloride concentration in the wash liquor.

The results of the Composition VI experiments (pH 10.2) are shown in Table B.

TABLE B

| Chloride level in main wash (mg/l) | % $Cl^-$ in product added to wash liquor of 200 mg/l $Cl^-$ | Score |
|---|---|---|
| 0 | — | 1.0 |
| 60 | — | 1.0 |
| 180 | — | 1.0 |
| 200 | — | 1.1 |
| 225 | 0.825 | 1.3 |
| 237.5 | 1.20 | 1.7 |
| 250 | 1.65 | 3.3 |
| 300 | 3.30 | 3.7 |

These results show that a much higher chloride concentration in the wash liquor can be allowed at pH 10.2 before tarnishing of silver occurs. Under these conditions concentrations of up to 225 mg/l chloride can be tolerated before unacceptable tarnishing of silver starts to occur.

From the above results it can be seen that with decreasing pH of the wash liquor, silver tarnishing starts to occur at lower chloride concentrations and that the risk of tarnishing increases with decreasing pH of the wash liquor.

Although most water suppliers deliver water containing chloride in the range of 0 to 45 mg/l, there are still a significant number of suppliers delivering water containing chloride in the range of 46–90 mg/l; also chloride levels of above 225 mg/l do occur. Hence with increasing chloride concentrations in the tap water, less chloride can be tolerated in the product.

Taking variations of the chloride level in tap water and in the soil residue into account, the invention proposes an upper limit of 0.2% chloride level, preferably not more than 0.1%, as a safeguard to minimize the risk of silver tarnishing.

We claim:

1. Mildly alkaline enzymatic detergent cleaning composition adapted for use in automatic dishwashing machines having a solution-pH of from 9.3 to 10.8, determined from a solution of 3 g/l of the composition in distilled water, comprising a detergency builder and (i) from 0.2 to 5% by weight of an amylolytic enzyme such that the final composition has amylolytic enzyme activity of from $10^3$ to $10^6$ Maltose Units/kg;

(ii) from 5 to 25% by weight of a peroxy compound bleach selected from the group consisting of solid peroxy acids and their salts; and mixtures of an inorganic peroxide bleach compound with an activator wherein the ratio by weight of said inorganic peroxide bleach compound to activator is within the range of 10:1 to 1:1; and (iii) not more than 0.2% by weight of chloride.

2. Enzymatic detergent cleaning composition according to claim 1, comprising not more than 0.1% by weight of chloride.

3. Enzymatic detergent cleaning composition according to claim 1, wherein said peroxy compound bleach is a monoperoxyphthalic acid or its water-soluble salts.

4. Enzymatic detergent cleaning composition according to claim 1, wherein said peroxy compound bleach is a mixture of sodium perborate or sodium percarbonate with an activator selected from the group consisting of tetraacetyl ethylene diamine (TAED), tetraacetyl glycoluril (TAGU), glucosepentaacetate (GPA), xylose tetraacetate (XTA) and sodium acyloxy benzene sulphonate (SABS).

5. Enzymatic detergent cleaning composition according to claim 1, which further comprises a proteolytic enzyme.

6. Enzymatic detergent cleaning composition according to claim 1, wherein said amylolytic enzyme is present in the form of granules containing less than 30% by weight of chloride.

7. Enzymatic detergent cleaning composition according to claim 6, wherein said enzyme granules are substantially chloride-free.

8. Enzymatic detergent cleaning composition according to claim 5, wherein said proteolytic enzyme is present in the form of granules containing less than 30% by weight of chloride.

9. Enzymatic detergent cleaning composition according to claim 8, wherein said enzyme granules are substantially chloride-free.

* * * * *